United States Patent [19]

Hasenwinkle

[11] 4,111,247

[45] Sep. 5, 1978

[54] LOG CUTTING AND REJOINING PROCESS FOR LUMBER MANUFACTURE

[75] Inventor: Earl Dean Hasenwinkle, Longview, Wash.

[73] Assignee: Weyerhaeuser Company, Tacoma, Wash.

[21] Appl. No.: 759,166

[22] Filed: Jan. 13, 1977

[51] Int. Cl.[2] ..... B27K 1/08

[52] U.S. Cl. ..... 144/316; 144/312; 144/314 R

[58] Field of Search ..... 144/316, 314 R, 312, 144/326 R

[56] References Cited

U.S. PATENT DOCUMENTS

| | | | |
|---|---|---|---|
| 2,544,935 | 3/1951 | Örner | 144/316 |
| 3,961,654 | 6/1976 | Hasenwinkle | 144/312 |

FOREIGN PATENT DOCUMENTS

| | | | |
|---|---|---|---|
| 2,404,898 | 8/1974 | Fed. Rep. of Germany | 144/314 R |

*Primary Examiner*—Donald R. Schran

[57] ABSTRACT

A process for making composite lumber products from generally cylindrical logs includes the steps of cutting a log radially into a plurality of first sector-shaped pieces having similar included angles and then preferably drying the sector-shaped pieces. After drying, the sector-shaped pieces are preferably machined to provide flat surfaces for subsequent gluing and rejoining steps. The sector-shaped pieces are then divided into at least two members where each plane of cut will be substantially parallel to the chord base plane with at least one of the resulting members having a thickness substantially equal to the thickness of the final composite lumber. At least two of the resulting members, substantially equal in thickness, are then rotated and bonded together along juxtaposed edges into a composite planar piece. Additional members substantially equal in thickness can be alternately rotated and edge bonded to the composite piece thereby forming wider widths. Alternate members in the composite piece can have the taper reversed longitudinally if a higher lumber yield is desired. The wide width composite pieces can then be rip cut longitudinally to yield pieces of the desired width. A finger jointing process and final surfacing can be applied to the composite lumber. The resulting composite lumber is generally flat grained over the two wider faces and each resulting piece will have at least one inclined glue line throughout its length.

23 Claims, 15 Drawing Figures

Fig. 6B
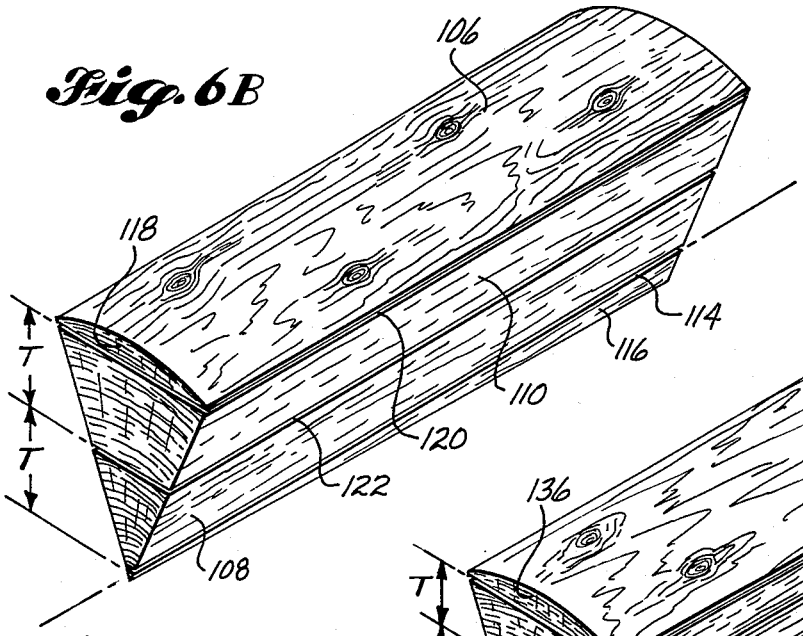
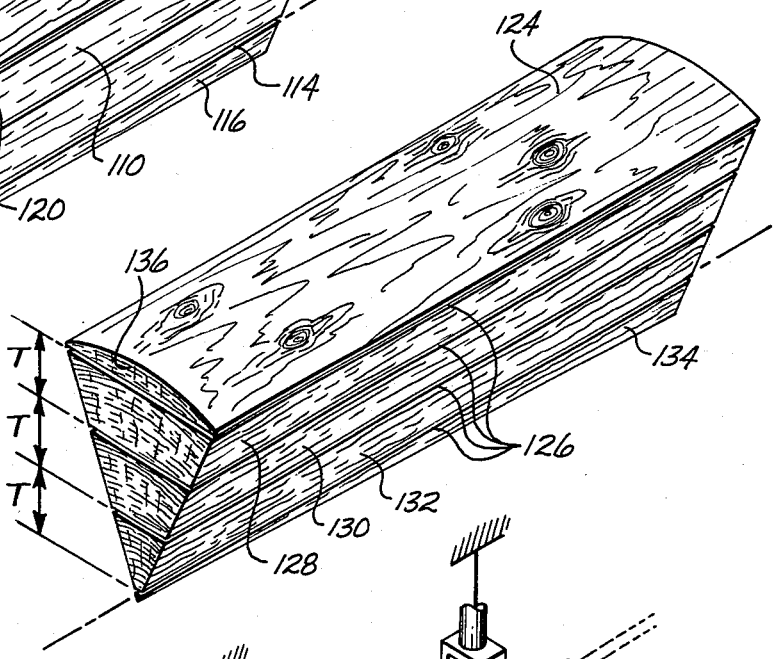
Fig. 6C
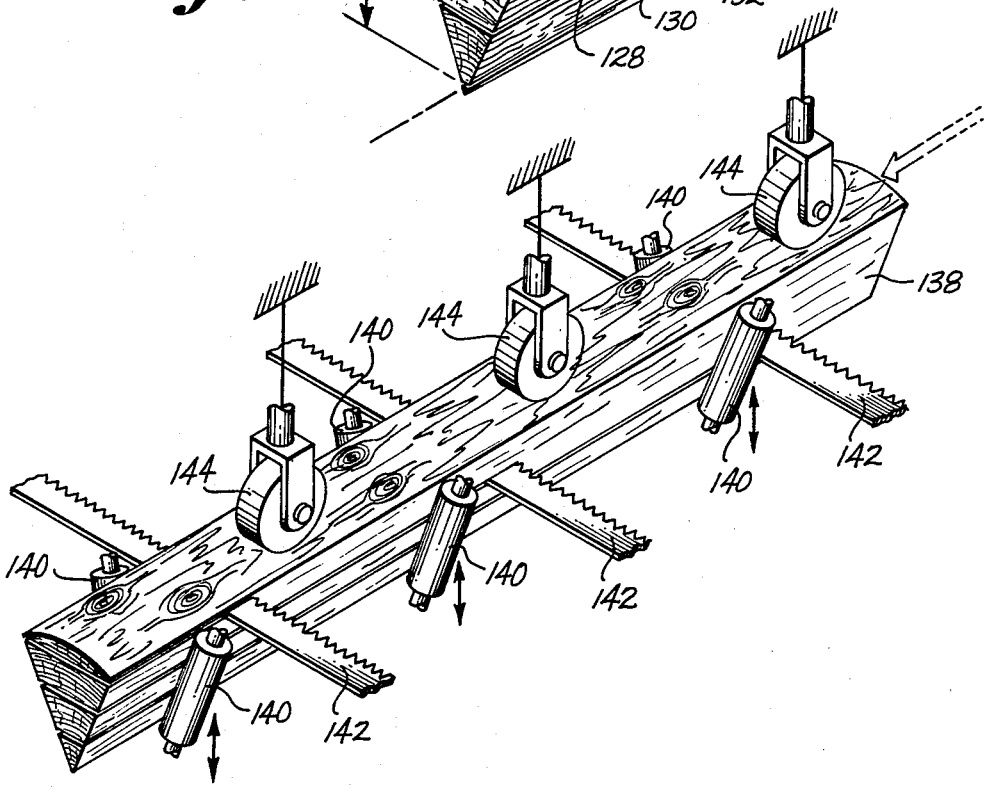
Fig. 7

LOG CUTTING AND REJOINING PROCESS FOR LUMBER MANUFACTURE

BACKGROUND OF THE INVENTION

This invention relates generally to a process for converting round logs into lumber products, primarily dimension lumber. More particularly, it relates to a log cutting and subsequent rejoining process for converting logs into composite lumber products whereby the yield of lumber from the round wood volume is significantly increased.

In the commonly assigned U.S. Pat. Nos. 3,903,943 and 3,961,654, two cutting and rejoining processes are disclosed that can be utilized for increasing the lumber yield from logs which include certain of the steps employed in the cutting and rejoining process of the present invention. The disclosures in the above-cited issued U.S. Patents are incorporated herein by reference for purposes of providing a complete description and understanding of the present invention.

The centuries-old conversion process of sawing logs into rectangular lumber results in a low yield in that, of the total volume of wood in a log, usually less than half is or can be converted into usable lumber. This is primarily because of the limitation that square or rectangular pieces are cut from a cylindrical log. The actual lumber yields utilizing known processes, of course, vary depending upon a number of factors, such as log diameter and curvature, but even with the best available computer-controlled sawing machines, a normal yield of lumber from an average log is 50% of the total wood volume. With smaller logs the yield is substantially less. The term "lumber" is intended to mean those wood products traditionally having the highest marketable value that are derivable from a longitudinal sawing pattern imposed on a log and which are generally rectangular in cross-section.

The most commonly used log-to-lumber converting process is where saws make a plurality of longitudinal cuts through the log with each successive cut generally being in a plane parallel or perpendicular to an adjacent previous cut. With this process, it is obvious that there are yield limitations simply from the fact that the beginning raw material is cylindrical while the desired final lumber product is rectangular in form. The wood volume not converted into lumber is utilized in a variety of other ways, none of which offer the value of lumber. The sawdust can be used as fuel, particleboard and the like. The solid wood slabs and edgings can be chipped into small pieces suitable for wood pulp production or likewise they can be used for fuel.

In the past, there have been many suggestions of ways to increase the recovery of solid wood products that could be converted from a log. Veneer production and subsequent laminating methods has been one suggestion. In veneer production the cylindrical log is converted into pieces of wood veneer which can then be laminated together to form various wood products such as plywood. Such composite products and their converting processes do convert more of the wood volume into wood products, but they do not have the characteristics of solid sawn lumber.

The aforementioned U.S. Pat. No. 3,961,654 incorporated herein by reference discloses a process and resulting product that can be employed to greatly increase the yield of lumber from cylindrically shaped logs. The process as disclosed is best applied to small logs such as from 5 to 15 inches in diameter. The process described in issued U.S. Pat. No. 3,903,943 is best applied to logs having larger diameters.

Yet another new alternative cutting and rejoining process was conceived from the concept of cutting logs into sector-shaped pieces. The cutting and rejoining process of the present invention results in fewer bonding steps, thereby simplifying the process while still yielding a greatly increased percentage of composite lumber products. It is anticipated that the resulting composite pieces of lumber will have a high value and will be accepted in the marketplace as lumber products.

Accordingly, from the foregoing, one object of the present invention is to convert generally cylindrical logs into composite lumber products whereby the percentage of log volume that is converted to lumber is substantially increased.

A further object is to simplify the process as disclosed in U.S. Pat. No. 3,961,654.

Still a further object is to provide a lumber cutting and rejoining process that yields substantially all flat grained composite lumber.

These and other objects will become more apparent and better understood upon reading the following specification in conjunction with the attached drawing.

SUMMARY OF THE INVENTION

Briefly, this invention is comprised in one form of longitudinally cutting a log segment radially into a plurality of first sector-shaped pieces having similar included angles. Each of the sector-shaped pieces is then divided longitudinally into at least two members where each plane of cut will substantially parallel the chord base plane with the thickness of at least one of the members being substantially equal to the thickness of the resulting composite piece of lumber. At least two resulting members substantially equal in thickness are then rotated about a longitudinal axis with respect to each other and bonded together along the inclined juxtaposed edges into a composite planar piece. Additional bonding and machining steps can be performed. The resulting composite lumber products are flat grained and each composite piece has at least one inclined, longitudinally extending glue line.

BRIEF DESCRIPTION OF THE DRAWINGS

FIGS. 6A–6C depict the subsequent cutting process for cutting from the individual sector-shaped pieces a plurality of substantially trapezoidally shaped pieces.

FIG. 7 depicts in isometric form an individual elongated sector-shaped piece being cut into a plurality of trapezoidally shaped pieces.

DESCRIPTION OF THE PREFERRED EMBODIMENT

Figure 1:
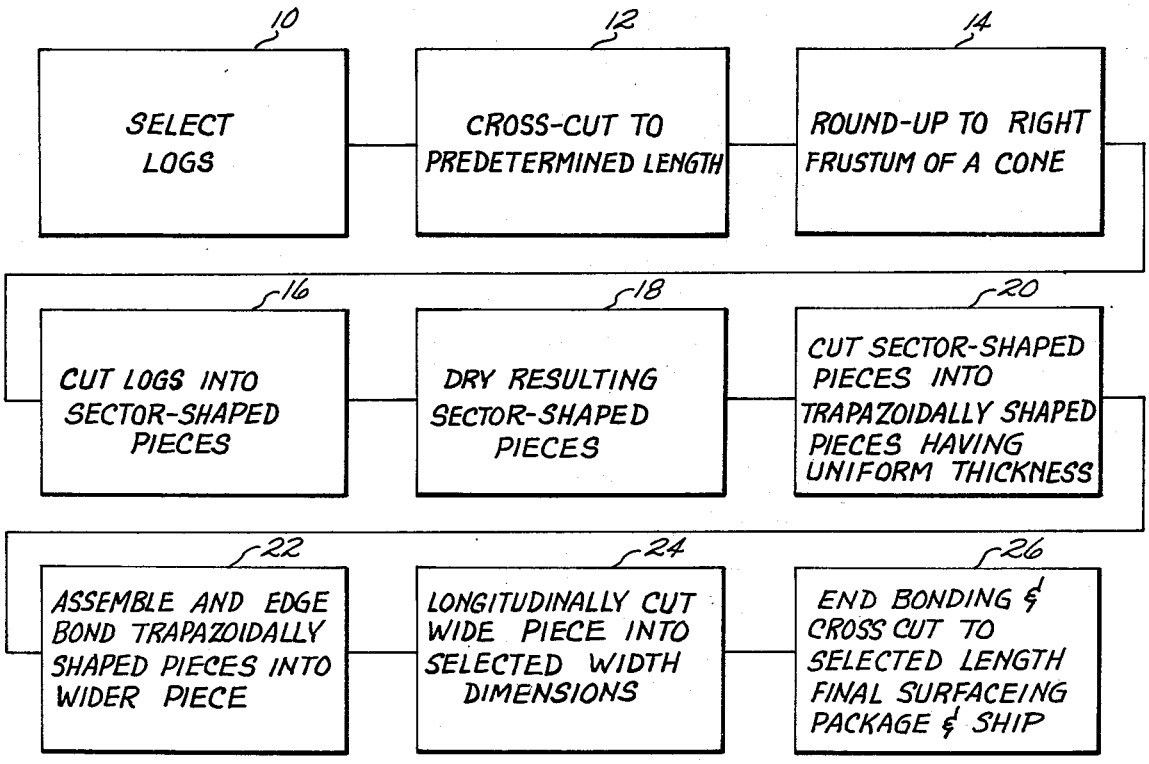
FIG. 1 is a block diagram showing the steps within the process of the present invention.

Turning first to FIG. 1, a general description of the complete process will be given in order to disclose each of the basic unit processes within the overall process so that one skilled in the art of lumber manufacturing will have an immediate understanding of the present process and how it compares with prior art lumber manufacturing processes. The first unit process is depicted by process box 10 entitled "Select Logs." The log selection process is concerned primarily with selecting logs meeting correct grade and size standards. In carrying out the overall process of this invention, logs with substantially sound wood, free of rot and other major defects, will be selected for the manufacturing process. In view of the fact that the overall process yields a composite lumber product, the log grades will necessarily be carefully determined prior to selection for use as raw material in the process. Log size is also important in that in order to simplify the use of the various machinery within each of the unit process steps a given log size class will normally be selected for processing over a given time. For example, a minimum number of logs within a diameter class ranging from 8.1 inches to 9.2 inches will be accumulated, having the proper grade, and they will then be converted into the composite lumber product over whatever manufacturing time is required. By having the preselected diameter classes and grade, manufacturing time can be minimized while maintaining good quality standards in the finished composite lumber products.

The next unit process within the overall manufacturing process is indicated by process box 12 entitled "Cross-Cut to Predetermined Length." In this step of the process the logs that have been selected according to size and grade are simply cross cut or bucked into a standard predetermined length which could be on the order of, for example, 8'6". This unit process can be carried out on any known equipment for bucking logs, and for high processing rates the logs could be processed in what has become known in the lumber manufacturing industry as a "merchandizer." A merchandizer is a substantially automatic log handling, sizing, cutting and sorting system. A merchandizer could, for example, automatically size and grade the incoming logs and then cross cut them to the predetermined length and automatically sort them according to grade and size into sort pockets.

Through unit processing steps 10 and 12, the logs are graded and sized according to diameter and length. However, they still have their common rough tapered envelopes. The unit process box 14 entitled "Roundup to Right Frustrum of a Cone" is that step in the overall process whereby the logs are machined at their outside surface into a predetermined shape. The unit process box 14 is to depict the machining step for smoothing the outside envelope of the log with uniform taper or to smooth the outside surface of the log and remove the taper. In capturing taper the roundup step will remove the minimum amount of surface wood in order to generate a right frustum of a cone. If for processing reasons it is determined that the taper volume should be removed, then the roundup process will remove the minimum amount of wood that smooths the outside surface while removing the taper volume, thereby yielding a right cylinder. As will be more fully appreciated later, this roundup step to include taper will yield an additional increment in product yield from a given volume of incoming raw material.

The next unit processing step is depicted at process box 16 entitled "Cut Logs into Sector-Shaped Pieces." At this step in the process, the logs are cut into individual elongated sector-shaped pieces, each having a predetermined size. Generally the sectors are of a uniform angle size between radial faces in order to simplify the manufacturing process. In order to yield the maximum amount of composite lumber product from the overall process, the angle size selected for the elongated sector-shaped pieces will generally have a maximum size of about 60°. This value should be taken by way of example only and it is not intended to limit the scope of the invention.

After the elongated sector-shaped pieces have been cut from the selected logs in a continuous manufacturing process, they are dried. The unit processing box 18 entitled "Dry Resulting Sector-Shaped Pieces" is to depict the moisture removal step for the wet green sector-shaped pieces. The primary reason for drying the sector-shaped pieces to a moisture content of below 20% is for the subsequent bonding steps. While at the present time it is within the contemplation of the present invention to dry sector-shaped pieces, suitable adhesives can be formulated to bond green sector-shaped pieces and thereby eliminate the need for a drying step.

The next unit processing box 20 entitled "Cut Sector-Shaped Pieces Into Trapezoidally Shaped Pieces Having Uniform Thickness" is to depict the breakdown step for the individual elongated sector-shaped pieces into trapezoidally shaped pieces for subsequent rejoinder. Here the sector-shaped pieces are longitudinally cut into substantially trapezoidally shaped pieces with each having a predetermined thickness dimension which is selected according to the finally desired composite product thickness. In this step, depending upon whether or not the roundup step yields a right frustum of a cone or a perfect right cylinder, as will become more apparent later, a smaller elongated triangular-shaped piece may result. By definition, the smaller resulting triangular-shaped piece will be considered to have a substantially trapezoidally shaped cross-section. It is at this step in the manufacturing process where the outside curvilinear chord base portion of the log is removed from the elongated sector-shaped pieces for conveying out of the present manufacturing process. The resulting wood volume can be directed to a chip manufacturing facility or it could be, for example, directed to a process where it is converted into wood fuel for energy production. As will be well apparent to those skilled in the art, one intent within the overall manufacturing process would be to cut the smallest volume from the top of the sector-shaped pieces, thereby resulting in the highest yield in composite lumber product.

The next step within the overall manufacturing process is depicted in unit processing box 22 entitled "Assemble and Edge Bond Trapezoidally Shaped Pieces Into Wider Piece." Here, within this unit process step, at least two trapezoidally shaped pieces having a substantially similar thickness are bonded together edgewise along an inclined bonding line to form a wider composite piece. With respect to two trapezoidally shaped pieces coming from an elongated sector-shaped piece, one trapezoidally shaped piece will be rotated 180° about a longitudinal axis and the two will then be bonded together along juxtaposed inclined edges. With the just-described orientation of the two trapezoidally shaped pieces, after edge bonding the resulting wider composite piece will be a parallelogram in cross-section.

Additionally, if the taper volume is included within the trapezoidally shaped pieces, every other piece prior to its being bonded together with an adjacent piece, will also be reversed endwise in order to incorporate the taper volume within the resulting wider composite piece. In order to make infinitely wide composite planar pieces, additional trapezoidally shaped pieces of uniform thickness can be edge bonded together, yielding the wide piece. These processing steps will be more fully understood when referring to other figures of the drawings later during the description.

The unit processing box 24 entitled "Longitudinally Cut Wide Piece Into Selected Width Dimension" indicates that if an infinitely wide composite piece is produced, it will then be longitudinally cut into predetermined widths as determined by the final product dimension. This step is often referred to as rip-cutting. The longitudinal cutting step results in individual elongated composite lumber products having a predetermined thickness, width, and length and the pieces will be suitable for the many uses that typical lumber products have.

The last unit processing box 26 entitled "End Bonding and Crosscut to Selected Length, Final Surfacing, Package and Ship" is actually several unit processes combined into a single block. The end bonding step is to increase the length of the resulting composite pieces from unit processing box 24. Here composite pieces of uniform width are end bonded together, using any suitable known method and means, typically referred to as end gluing in order to produce an infinitely long uniformly wide composite lumber product. The resulting infinitely long composite piece is then crosscut into selected lengths of predetermined width and thickness. After crosscutting to length, the resulting composite piece may be surfaced to yield the desired shape and smoothness and then packaged for shipment to the customer.

Figure 2:
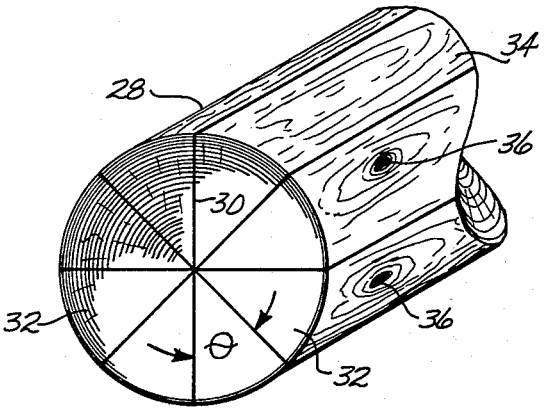
FIG. 2 is an isometric view showing one end of a portion of a log segment showing radial cutting planes.

Turning now to FIGS. 2–5, addition details of unit processing boxes 10–18 will be given. FIG. 2 shows an isometric end view of a typical log 28 that is suitable for processing through the present invention. Log 28 is shown with a plurality of radial lines 30 superimposed over the end cross-section in order to depict the radial cutting planes for producing elongated individual, sector-shaped pieces, each indicated as 32. The outside curvilinear envelope of log 28 is indicated at 34 and has protruding therefrom a plurality of natural protuberances such as knots indicated at 36.

Figure 3:
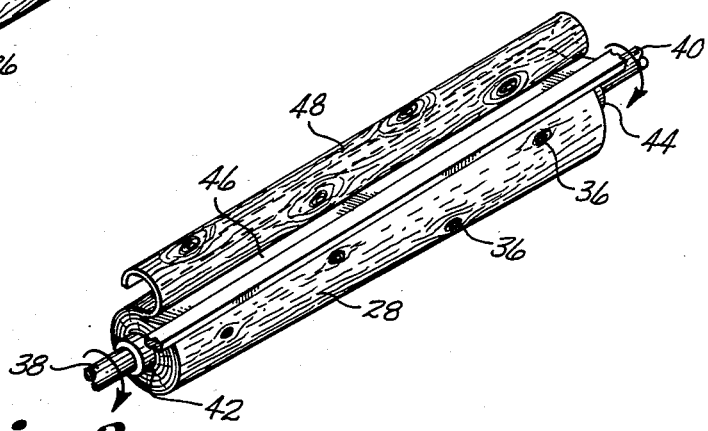
FIG. 3 shows in schematic form a log being rounded up by a lathe knife.
Figure 4A:
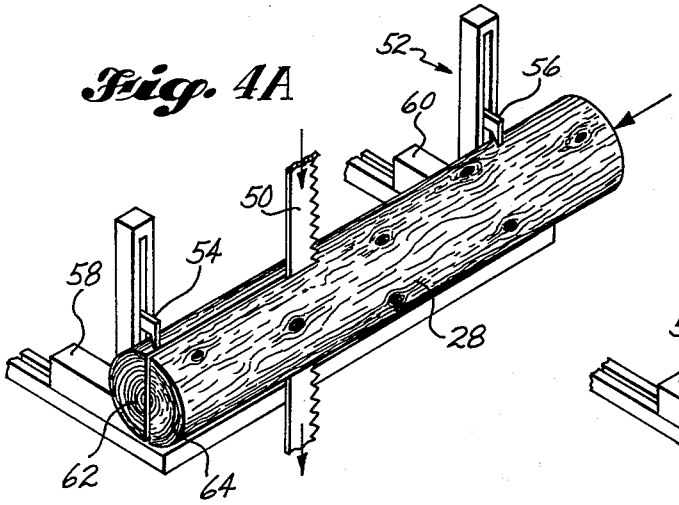
FIGS. 4A–4C depict the sector cutting process whereby a log is cut into a plurality of elongated sector-shaped pieces.
Figure 4B:
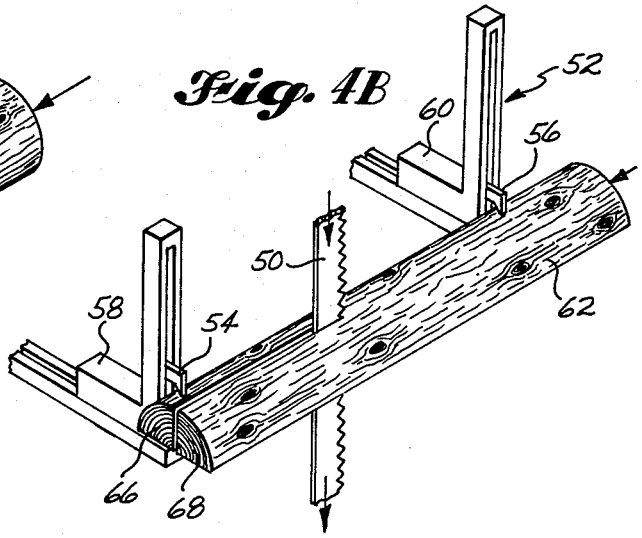

In FIG. 3, log 28, which has been cut to a predetermined length, is shown being rounded up according to unit process 14. The roundup process could be carried out on a conventional plywood-type lathe having a pair of rotatable spindles 38, 40 together with a pair of end dogging chucks 42, 44. After log 28 is positioned in the lathe apparatus and chucked solidly in place, a transversely extending peeling knife 46 is suitably adjusted so as to begin removing a controlled amount of surface wood indicated at 48 from logs 28. If the logs 28 are being rounded up into a right frustum of a cone, the knife 46 will be slightly skewed in order to generate the right frustum. The log 28 is turned until the knife blade has moved in a predetermined distance to remove the minimum required amount of surface wood 48. When log 28 is removed from the lathe apparatus, its outer envelope 34 will be substantially smooth and free of the knots 36 and other protuberances. Additionally, the log will either be in the form of a right frustum of a cone if taper volume is to be utilized or in the form of a perfect right cylinder. After logs 28 have been rounded up, they will then be conveyed into unit processing area 16 where they will be cut into a plurality of elongated sector-shaped pieces. In FIG. 4A, log 28 is halved by a typical vertical-plane band saw 50. Log 28 is dogged on a typical longitudinally movable carriage assembly depicted generally at 52. A pair of dog members 54, 56 serve to bite into log 28 at each end and hold log 28 on carriage 52. Typical slide blocks 58, 60 serve to provide the lateral position of log 28 and to therefore control the position of the halving cut. Band saw 50 will divide log 28 into two half-sections 62, 64 for further breakdown which is depicted in FIG. 4B. Each half-section of log 28, the half-section in FIG. 4B being designated as 62, is then again halved into substantially quarter-sector pieces 66, 68. This halving process can be carried out on a band-sawing apparatus similar to that depicted in FIG. 4A.

Figure 4C:
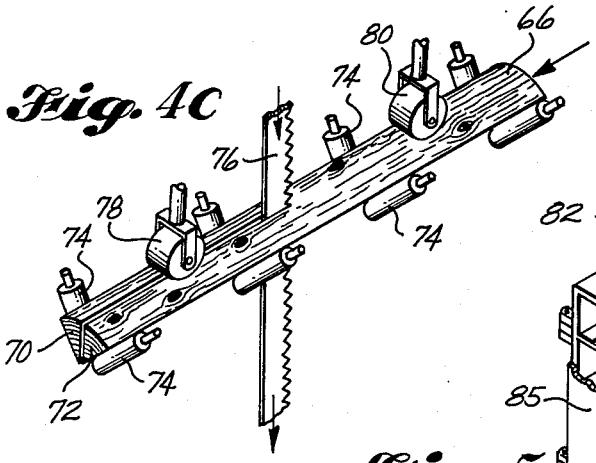

In FIG. 4C, one of the quarter sectors, being depicted as 66, is further reduced into a pair of elongated sector-shaped pieces 70, 72 which would each have an included angle $\theta$ of approximately 45°. The quarter sector 66 is conveyed longitudinally within a V-shaped conveying system having inclined rollers 74 past a vertically disposed band saw 76. Additionally, suitable top hold-down rolls 78, 80 are desirable in order to hold quarter piece 66 within its intended conveying path as it travels past band saw 76. The sawing apparatus as depicted in FIG. 4C may be substantially similar to that disclosed in U.S. Pat. No. 3,961,654. As disclosed within the aforementioned U.S. patent, rollers 74 can be adjustably mounted so as to accept and convey sector-shaped pieces of varying included angles.

Figure 5:
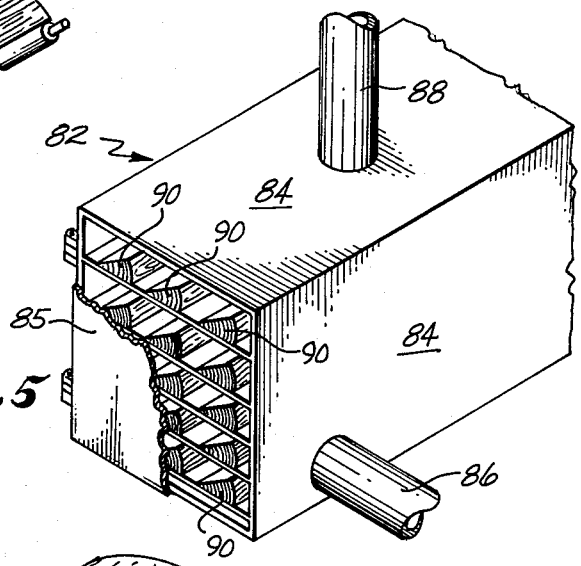
FIG. 5 is a schematic depiction of a typical lumber dry kiln suitable for drying the elongated sector-shaped pieces.

After the individual elongated sector-shaped pieces 70, 72 are cut to their final size, they will then be conveyed into any suitable drying apparatus 82. FIG. 5 depicts a standard dry kiln having a plurality of sidewalls 84 and end doors 85 enclosing a space within which the individual, sector-shaped pieces will be placed for drying. An inlet conduit 86 is attached to a source of hot gas which is caused to flow through conduit 86 and into kiln 82 where it circulates substantially in a predetermined manner and exits through outlet conduit 88. The circulating hot gas evaporates a portion of the moisture within the elongated sector-shaped piece, each of which is singly depicted at 90 and carries it out through outlet conduit 88, thereby drying the pieces to a desired moisture content. After the pieces are dried, they are removed from kiln 82 and will then be ready for the next processing step.

Figure 6A:
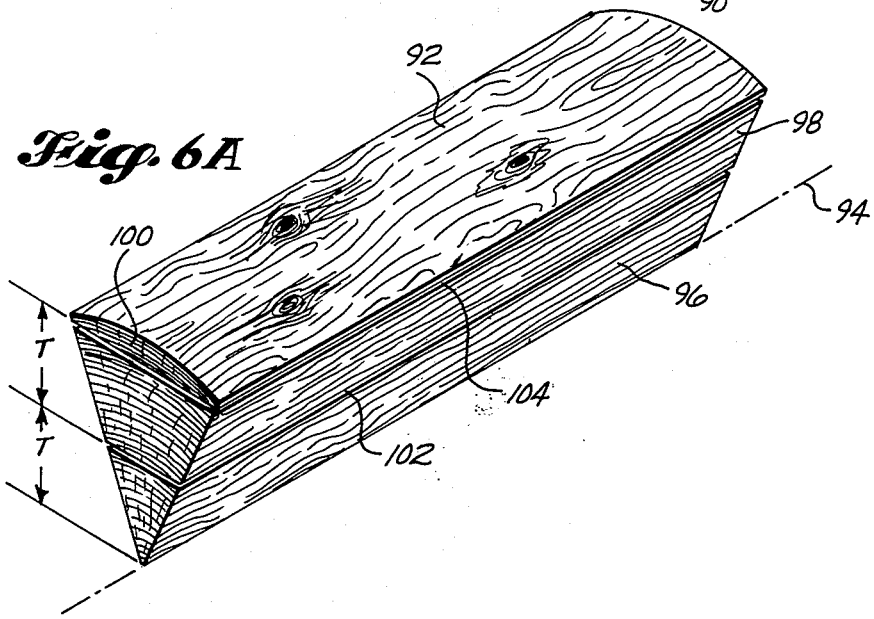

Additional details of the unit processing step of box 20 will now be described. In FIG. 6A an individual, elongated sector-shaped piece 92 is depicted that has been cut from log 28 that was a perfect right cylinder. This means that the radial dimension at each end of piece 92 is the same and that there is no taper volume left within piece 92. The longitudinal axis line 94 corresponds to the center line of the right cylinder log. Sector-shaped piece 92 has been sized so as to yield two elongated, trapezoidally shaped pieces, one being indicated at 96 and the other being indicated at 98. In this particular instance, the elongated piece 96 will be substantially in the form of a triangle with one apex coinciding with the center line of the log. Each piece 96, 98, has a thickness value of T as depicted in the figure. It will be pointed out here by way of example that if the finally desired thickness of the composite lumber product is to be on the order of 1½ inch in nominal thickness, then each piece 96, 98 will have a T value of approximately 1.50 inches and therefore the log diameter to yield two such pieces from single sector-shaped piece 92 will be approximately 6.50 inches, which includes an amount for losses due to kerf, drying and surfacing.

In cutting the pieces 96, 98 from the elongated sector-shaped piece 92, a resultant chord segment volume 100 will be generated. It is volume 100 which, as previously mentioned, is diverted from the process and converted to pulp chips or into fuel. As may be seen in FIG. 6A, each plane of cut 102, 104 made in cutting the elongated pieces 96, 98 is made substantially parallel to a chord plane, extending through sector-shaped piece 92. While the chord plane may be substantially coplanar with cutting plane 104, it is not an absolute requirement. However, they are usually coplanar because by making the segment volume 100 the minimum volume possible which would make the planes coplanar, addition yield of final composite lumber product can be generated.

In FIG. 6B the condition is depicted where log 28 had been rounded up into a right frustum of a cone in order to utilize the taper volume within log 28. The individual elongated, sector-shaped piece 106 depicted in FIG. 6B has a slightly different cutting pattern compared to that of FIG. 6A in order to utilize at least a portion of the taper volume. Again, the sector-shaped piece 106 has been sized in order to yield a pair of substantially trapezoidally shaped pieces 108, 110 with both having substantially equal thicknesses over their lengths. When an individual elongated sector-shaped piece has taper volume, it means that the radial dimension at one end is different than the radial dimension at the other end and the parallel cutting planes will be generated at an angle to the log center line. In this instance, the log center line which coincides with line 112 and one apex is slightly offset from the plane of cut 114 that generates one face of trapezoidally shaped piece 108. The small, elongated, triangular-shaped piece 116 between plane of cut 114 and the apex is not usable for making of composite lumber products and may be utilized as chips or fuel similar to the chord segment volume 118 produced along the top of piece 106. The other parallel planes of cut 120, 122, each of which will be substantially parallel to a chord plane with plane of cut 120 substantially coinciding therewith, are made so as to generate the uniformly thick trapezoidally shaped pieces 108, 110.

In FIG. 6C there is depicted a larger elongated sector-shaped piece 124, having taper volume and which has a plurality of cutting planes 126 parallel to one another (and to a chord plane) to result in three substantially trapezoidally shaped pieces 128, 130 and 132, together with a resulting smaller elongated triangular-shaped piece 134 along the bottom. Again, a resulting segment volume 136 is generated that can be utilized for chips or fuel along with piece 134. The three resulting trapezoidally shaped pieces are all of substantially uniform thickness and suitable for use in making the wider composite piece within unit processing step 22.

FIG. 7 depicts a sawing machine that can be utilized for generating three longitudinally extending parallel planes of cut in an individual elongated sector-shaped piece depicted at 138. Again, a plurality of vertically biased rollers 140 form a V-shaped conveying channel through the plurality of vertically spaced, horizontally disposed band saws 142. A plurality of top hold-down rolls 144 positioned on a horizontal plane serve to constrain the traveling sector-shaped piece 138 in its proper orientation during this cutting step. The sawing machine of FIG. 7 could take other forms and the apparatus depicted is only one example of a suitable sawing machine. For example, in order to make the top and bottom parallel planes of cut on an individual sector-shaped piece that has taper volume, suitable chipping heads could be employed and would be positioned accordingly. The rollers 140 are preferably angularly adjustable so as to accept sector-shaped pieces with different included angles $\theta$. Similarly, the vertical spacing of individual band saws 142 could be adjustable in order to generate varying thicknesses in the resulting trapezoidally shaped pieces.

Figure 8:
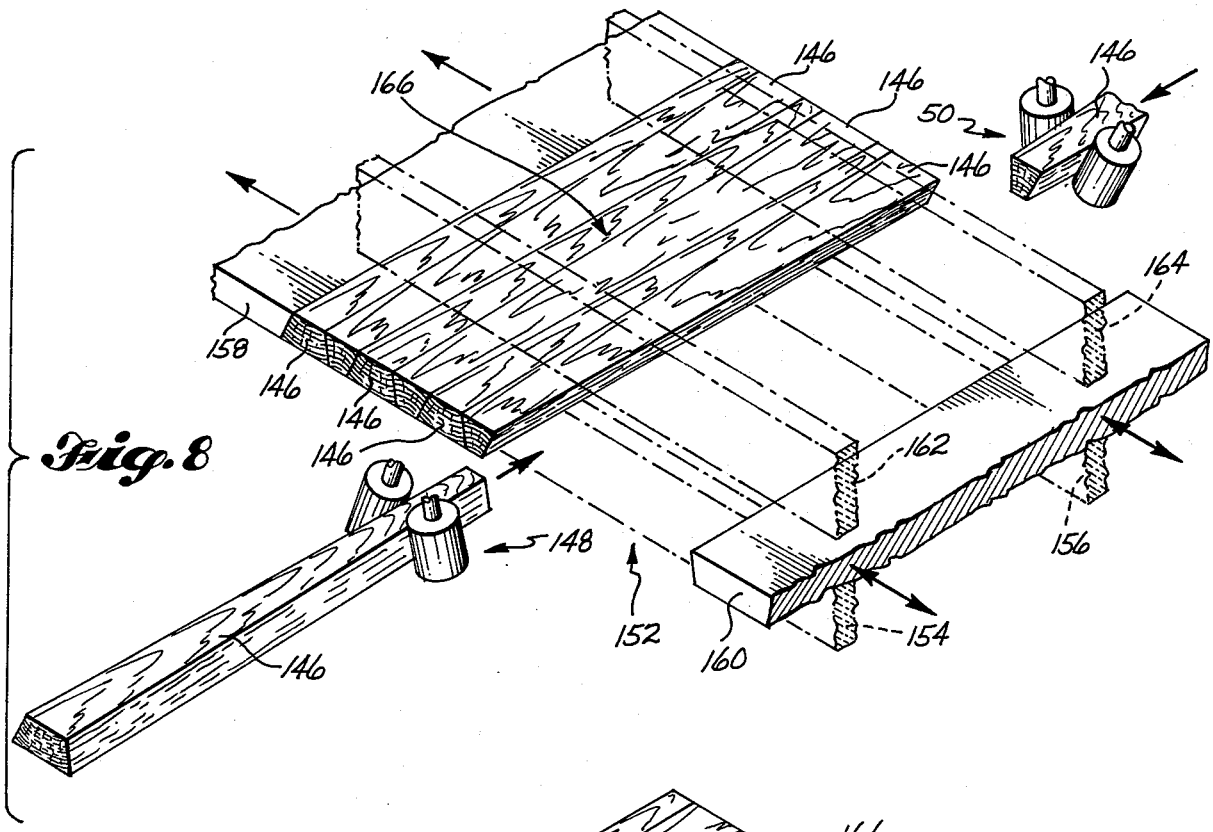
FIG. 8 is a schematic representation of the individual elongated trapezoidally shaped pieces being edge bonded together after having been rotated and properly positioned.

Turning now to a more complete description of the unit processing step of box 22, reference will be made to FIG. 8 wherein the assembly and edge bonding process is depicted. Here individual trapezoidally shaped pieces 146 of uniform thickness will have their inclined side edges spread with suitable adhesive as they pass through adhesive applicators indicated at 148 and 150. Pieces 146 will be fed through their respective adhesive applicator alternately, from either side of the accumulating section of an edge press, indicated generally at 152. Each of the individual pieces 146 will have been cut from a similarly sized elongated sector-shaped piece in order to have the opposed inclined side edges of the adjacent pieces compatible with one another. When the inclined edges are compatible, the resulting wider piece will be substantially planar, having parallel top and bottom surfaces. The opposed side feeding is to allow the pieces with taper to be inserted alternately in order to maintain uniformity along the increasing end edges of the resulting wider piece.

The edge press 152 may be comprised of, for example, a pair of spaced supporting rails 154, 156 on top of which are carried the individual trapezoidally shaped pieces 146. The slidable edge platen 158 serves to exert a pressure on first edge of the first piece 146 of the wider composite member. It is adapted to slide as additional individual pieces 146 are pushed toward it by the pusher platen 160. A pair of top hold-down rails 162, 164 are provided in order to constrain the wider composite piece 166 as it increases in size. As the individual pieces 146 are alternately fed into press 152 to a position atop rails 154, 156, platen 160 will then push the two new pieces in a direction toward platen 158 so the loading section will be ready to receive the next two incoming trapezoidally shaped pieces. The press 152 is extended in a downstream direction an amount necessary to provide suitable cure time for the inclined edge bonding lines. As earlier mentioned, the edge-bonded wider composite piece 166 could be made infinitely wide, provided there was an infinitely long edge press. The edge press is, as previously mentioned, only long enough to allow for sufficient cure time and the composite pieces 166 will be longitudinally cut in sheet form to a finite width at the outfeed end of press 152.

Figure 9:
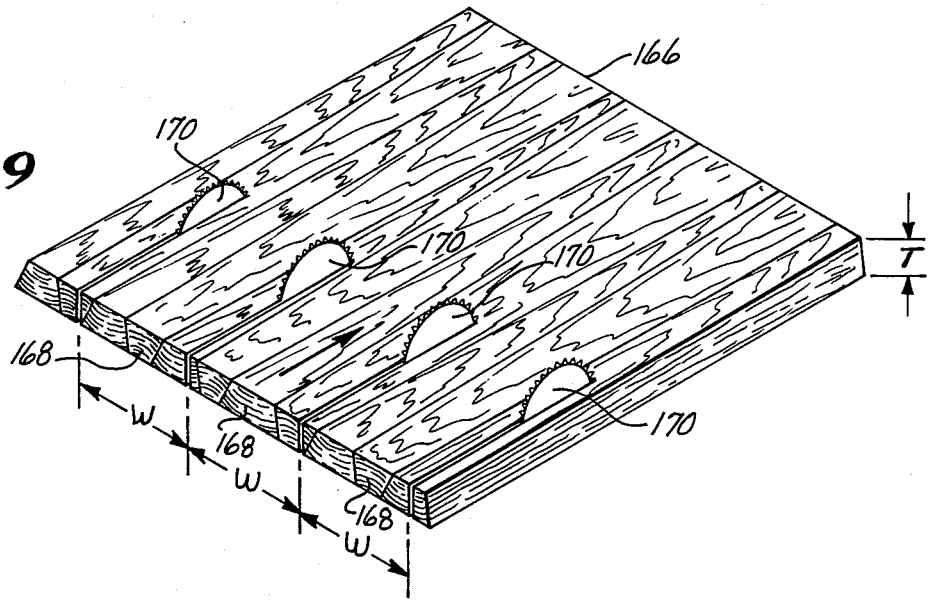
FIG. 9 is an isometric view of the wide dimension member having a plurality of round saws forming cutting planes and depicting longitudinal rip cutting.

In FIG. 9, one of the resulting wider composite members 166 in sheet form is depicted and is shown being longitudinally cut into individual elongated composite members, each indicated at 168. A plurality of vertically disposed round saws 170 make the cuts and each composite piece is shown with a uniform width dimension "W" and thickness dimension "T." As may be clearly seen in FIG. 9, each resulting elongated composite member 168 has a plurality of inclined edge bonding lines joining the individual, trapezoidally shaped pieces together. The resulting composite members 168 will have what is commonly referred to as a flat grain pattern over their wider faces. This resulting grain pattern may be contrasted with the resulting grain pattern from the process as disclosed in the aforementioned U.S. Pat. No. 3,961,654, which yields a composite lumber product having a vertical grain pattern over its wider faces.

Figure 10:
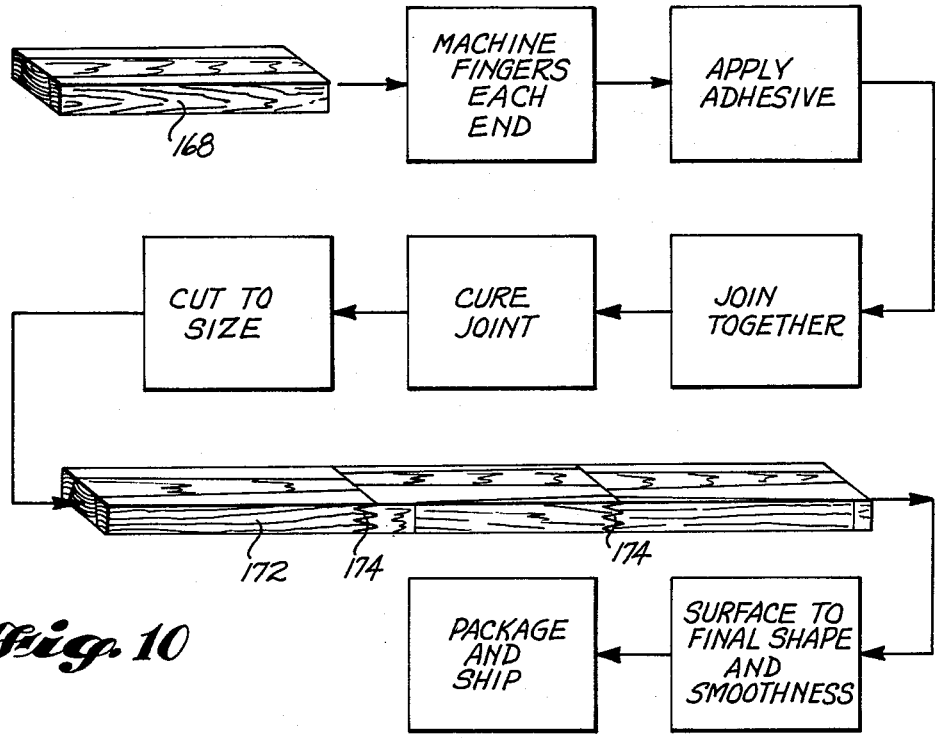
FIG. 10 is a block diagram showing the individual process steps within the last process block of FIG. 1.

FIG. 10 depicts the processing step of box 26 in more detail, but is still depicted in schematic form since all of the individual steps are well known in the lumber manufacturing art. Beginning with one of the composite members 168 generated by the longitudinal cutting step depicted in FIG. 9, the end bonding step is performed. Any suitable end bonding process is within the contemplation of the present invention; however, in most typical instances, the process is a finger-joining process where the first step is the machining of suitable fingers on either end of a composite member 168 and then a suitable adhesive is applied to the resulting fingers with the next step being the joining together of two similar composite members 168 to form the longer composite member. The next step in the end bonding process is to cure the joint such that the adhesive is allowed to fully cure and form a strong and satisfactory joint. In most end-gluing processes, the process is continuous and member of selected length will result. The result is the composite elongated member depicted at 172 in FIG. 10. The composite member 172 has a plurality of finger joints 174 along its length. Since the composite member 172 now has the desired thickness, width and length, it is then ready for final surfacing and shaping. The piece 172 can be passed through a planing machine or an abrasive planer or any other suitable surfacing and/or shaping apparatus. A suitable number of similar elongated composite pieces are then accumulated and packaged for shipment.

Figure 11:
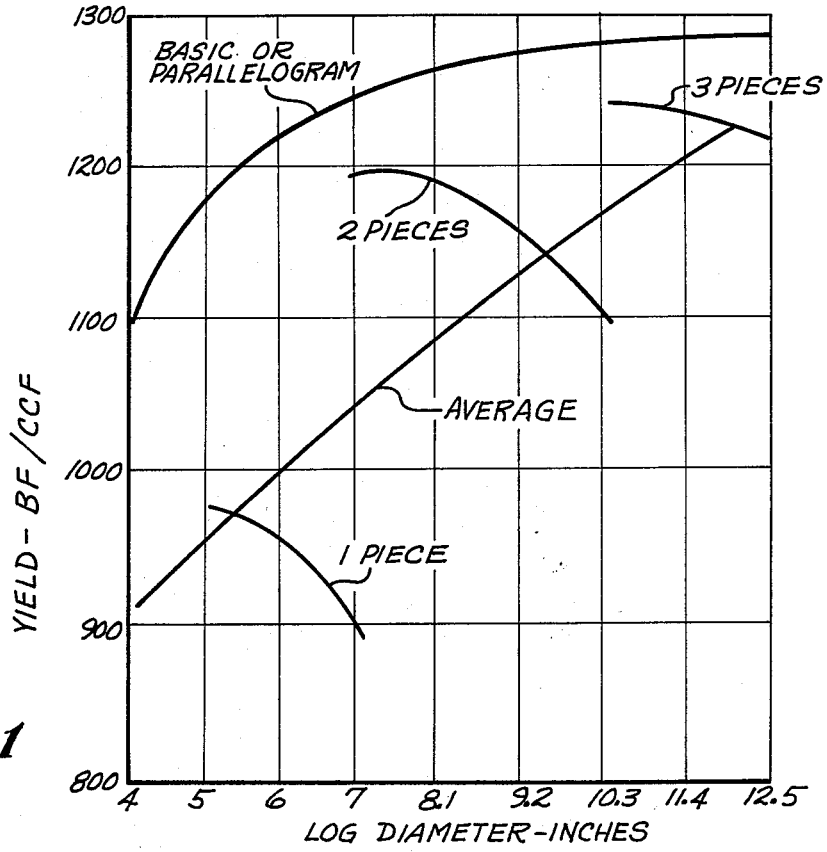
FIG. 11 is a graph depicting theoretical yields from logs of composite lumber product resulting from the present invention as compared to the yields of the invention disclosed in U.S. Pat. No. 3,961,654.

The graph in FIG. 11 shows curves depicting the yield of a composite lumber product in terms of board footage per cubic volume of raw material for a range of log diameters. The graph coordinates show log diameters from 4 inches up to 12.5 inches and yields from 800 up to 1,300 BF/CCF (board feet per 100 cu. ft. of log volume). The "Basic or Parallelogram" curve depicts the yield, over the log diameter range, of composite lumber product of the process disclosed in the aforementioned U.S. Pat. No. 3,961,654. The lower three downwardly sloping curves are for three variations of the present process. The lowermost curve, labeled "1 Piece," shows yields when a single trapezoidally shaped piece is cut from a sector-shaped piece previously cut from a log. The curve labeled "2 Pieces" is indicative of where two trapezoidally shaped pieces are cut from the sector-shaped piece and rejoined according to the present process. As may be seen from FIG. 11, the yields in this case resulting from log diameters between 7 to 10.3 range from 1,100 BF/CCF up to approximately 1,200 BF/CCF, well above the yields of a typical rectangular sawing process. The curve "3 Pieces" is indicative of the yield when a sector-shaped piece is cut into three trapezoidally shaped pieces and edgebonded together, resulting in yields higher than for the two-piece case, ranging from 1,220 BF/CCF up to 1,240 BF/CCF for logs of from 10.3 inches to 12.5 inches in diameter.

The three curves each show yields well above any of the traditional rectangular sawing processes, but all are slightly below the yields obtainable over the same diameter range from the basic sector-sawing process, as disclosed in the aforementioned U.S. patent. The single curve labeled "AVERAGE" is to depict what the average yield might be over the range of diameters when using the present invention. It should be apparent to one skilled in the lumber manufacturing art that the process of the present invention and the resulting elongated composite lumber products offer a significant increase in yield over other prior art processes. When compared to the process of the aforementioned U.S. patent, the process of the present invention has the advantage of requiring one less bonding step in order to yield the final composite product.

While a detailed description of the basic process and resulting composite lumber product has been made, it is to be understood that many additional changes and modifications may be made to the invention without departing from its true scope. All such modifications and changes are intended to be included within the scope of the appended claims.

What is claimed is:

1. A process for making a composite lumber product having substantially flat grained parallel top and bottom surfaces, comprising:

cutting from at least one log at least one elongated sector-shaped piece, cutting from said sector-shaped piece at least one elongated member having at least three sides with two of said sides being edges and portions of the radial faces and the other sides being substantially parallel to an elongated plane through the chord of said sector-shaped piece, said member having a thickness dimension extending perpendicular from one of said other sides to a location on a plane parallel to said other sides and which passes through the ends of the two side edges and being substantially equal to the thickness dimension of said composite wood product, and accumulating a plurality of said elongated members, with at least one of said members being trapezoidally shaped in cross-section, and bonding them together one to another, such that a side edge of each member is in juxtaposition with another side edge to form substantially a parallelogram in cross-section.

2. The process as in claim 1 including the step of preselecting said logs according to size and grade.

3. The process as in claim 2 including the step of cutting a plurality of logs having a predetermined size and grade.

4. The process as in claim 2 including the step of cross-cutting said preselected logs into predetermined lengths.

5. The process as in claim 4 in which said logs are cross-cut into uniform lengths.

6. The process as in claim 1 including the step of machining the outside surface of said logs into predetermined shapes.

7. The process as in claim 6 in which said logs are machined into right frustums of a cone, thereby including taper volume within said logs.

8. The process as in claim 6 in which said logs are machined into right cylinders, thereby removing taper volume from said logs.

9. The process as in claim 1 in which said logs are cut into a plurality of sector-shaped pieces having an included angle between radial faces of less than about 60°.

10. The process as in claim 9 in which said sector-shaped pieces are substantially similar in angular size.

11. The process as in claim 1 including the step of drying said sector-shaped pieces prior to said bonding step.

12. The process as in claim 1 in which all of said elongated members are trapezoidally shaped in cross-section.

13. The process as in claim 12 in which each of said members is of a uniform predetermined thickness.

14. The process as in claim 1 including the step of removing from said sector-shaped pieces the chord segment volume.

15. The process as in claim 1 including the step of longitudinally cutting said composite wood product into a plurality of individual pieces having predetermined widths.

16. The process as in claim 15 including the step of end bonding at least two of said composite wood products together.

17. The process as in claim 16 including the step of cross-cutting said longer length composite wood product into a selected length.

18. The process as in claim 1 including the step of preparing at least the side edges of said members to be joined together for adhesive bonding.

19. The process as in claim 7 including the step of reversing endwise every other member prior to bonding, thereby utilizing taper volume in said composite wood product.

20. The process as in claim 1 including the step of surfacing said composite wood product after bonding to form a final shape.

21. The process as in claim 1 in which said sector-shaped pieces to be cut are cut into a plurality of said elongated members with each member being substantially equal in thickness and trapezoidally shaped in cross-section.

22. The process as in claim 18 including the step of applying side edge pressure to cure the bonding line.

23. The process as in claim 22 including the step of applying top pressure to constrain said members in the shape of a parallelogram.

* * * * *